United States Patent [19]

Sipple et al.

[11] Patent Number: 4,509,223

[45] Date of Patent: Apr. 9, 1985

[54] GUN CLEANING TOOL

[76] Inventors: Douglas E. Sipple; Charles T. Wolstenholme, both of P.O. Box 65, Georgetown, Del. 19947

[21] Appl. No.: 519,586

[22] Filed: Aug. 2, 1983

[51] Int. Cl.[3] ..... F41C 31/00

[52] U.S. Cl. ..... 15/160; 15/145; 15/176; 15/210 R

[58] Field of Search ..... 15/105, 106, 107, 110, 15/111, 114, 118, 160, 166, 210 R, 210 A, 211, 214, 218.1, 220 R, 244 R, 104.2, 145, 176; 51/394, 400

[56] References Cited

U.S. PATENT DOCUMENTS

| | | | |
|---|---|---|---|
| 126,945 | 5/1872 | Finn | 15/118 |
| 190,123 | 5/1977 | Budd . | |
| 877,324 | 1/1908 | Gilbert . | |
| 1,811,205 | 6/1931 | Lee . | |
| 2,229,084 | 1/1941 | Horne . | |
| 2,723,414 | 11/1955 | Paltiel | 15/210 R X |

FOREIGN PATENT DOCUMENTS

| | | | |
|---|---|---|---|
| 46500 | 5/1929 | Norway | 15/210 R |

*Primary Examiner*—Edward L. Roberts
*Attorney, Agent, or Firm*—Bacon & Thomas

[57] ABSTRACT

A cleaning tool for cleaning various parts of a gun is disclosed in which three cleaning tips are removably insertable into a handle. The three cleaning tips include a first having bristles thereon to provide cleaning action between the rib and the gun barrel, a second cleaning tip has a woven cotton cover fixed to it to provide cleaning action and to absorb cleaning solvent, and the third tip has soft cotton fibers on its surface to apply oil after the cleaning operation is completed. The three tips are tapered in a direction toward their distal ends to permit their use in various sized openings.

16 Claims, 13 Drawing Figures

FIG 1
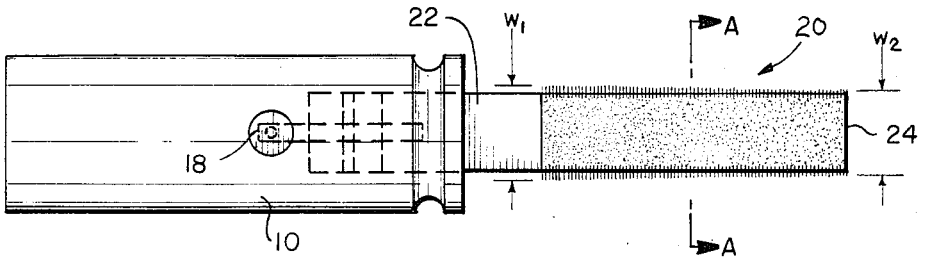
FIG 3
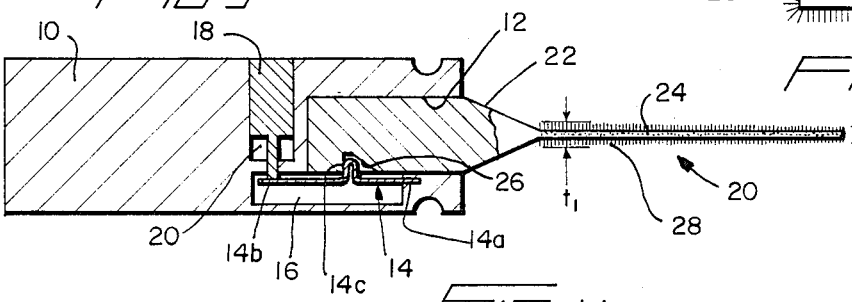
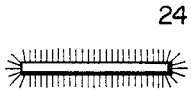
FIG 2
FIG 4
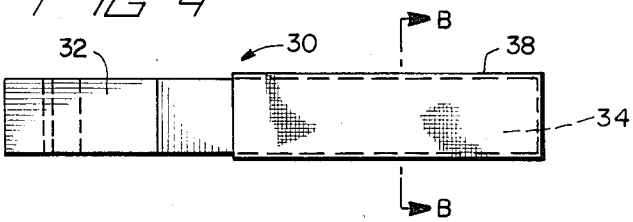
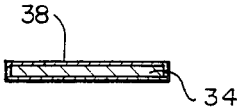
FIG 5
FIG 6
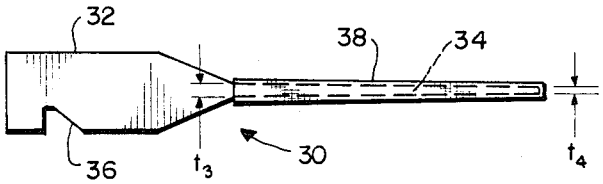
FIG 8
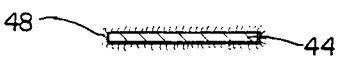
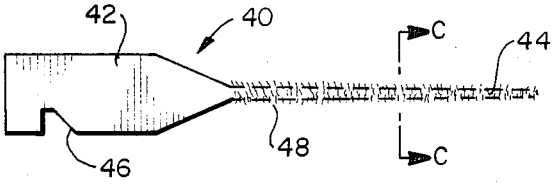
FIG 7
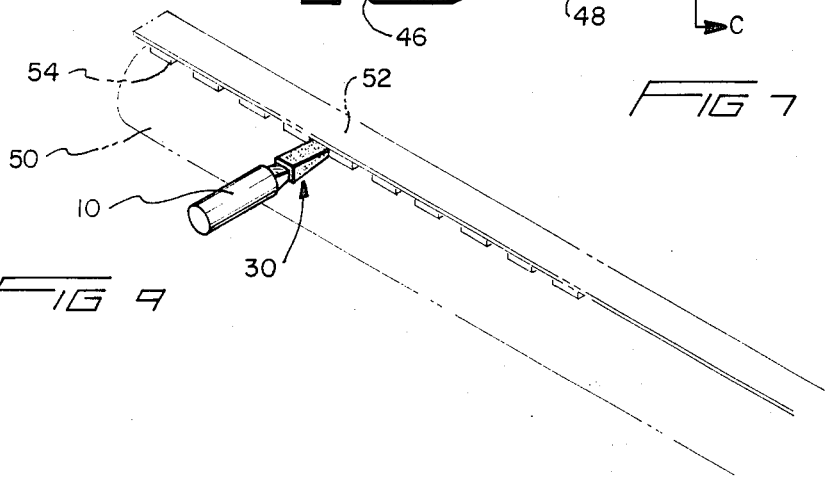
FIG 9

GUN CLEANING TOOL

FIELD OF THE INVENTION

The instant invention relates to gun cleaning tools, particularly such tools utilized to clean ventilated rib openings, trigger guard openings, revolver cylinder ends, etc.

BACKGROUND OF THE INVENTION

Many new varieties of tools have been developed over the years to facilitate the cleaning of guns. All of these prior art devices exhibit a cylindrical shape, since the elements they are designed to clean have such a shape. Although these cleaning tools serve quite well when it comes to cleaning barrels and breeches, they can not be utilized to clean other parts of the gun, such as ventilated rib openings, trigger guard openings, revolver cylinder ends and the like.

In the gun cleaning process, metal parts virtually inaccessible or those having narrow openings are either neglected or, worse, damaged through the use of makeshift metal or wood instruments to force a cleaning cloth along their surfaces. Typically, instruments such as screwdrivers, pocket knives, or small picks are employed. If the gun owner is conscientious, he might employ similar wooden instruments, but these have a tendency to break, leaving small slivers jammed in the opening. In all likelihood, he would then resort to a metal instrument to dislodge the sliver. Odds are that the weapon will be damaged, resulting in rust which is undoubtedly the most prevalent and serious malady confronting the gun owner, since this usually requires an expensive rebluing operation or part replacement to correct the condition and re-establish both the integrity and value of the weapon. In some instances, if left unattended, rust will eventually render the weapon unsafe for use. Thus, the current procedure is time consuming and potentially damaging to the weapon.

In order to clean such areas, the gun owner had to utilize a cloth swab which was manually manipulated in these areas. Quite obviously, this was a laborious and time consuming process.

The prior art is also replete with brushes of various shapes to accomplish specific cleaning purposes. However, although the prior art brushes may exhibit tapering or conical shapes, they almost invariably have circular cross sections. Clearly, such items are incapable of cleaning those areas of the gun previously described.

SUMMARY OF THE INVENTION

The gun cleaning tool according to the invention overcomes these shortcomings by providing a convenient special purpose tool for cleaning hard-to-reach surfaces, while not harming the weapon or its finish in any way.

The instant invention, in a first embodiment, provides a tool having a plurality of removable tip elements for cleaning and oiling hard-to-reach areas such as ventilated rib openings, trigger guard openings, trigger mechanisms, safety, slide actions on pump guns, and levers and slides/bolts on lever action weapons. A handle having a bore extending partially along its length and a latching mechanism is attachable to each of the tips in order to facilitate manipulation by the user.

Each tip has a shank portion defining a recess, which shank portion may be inserted into the bore of the handle. A spring clip latch mechanism engages the recess to retain the tip within the handle. A push button release mechanism is provided in the handle to displace the spring clip from the recess or notch and to permit removal of the tip from the handle.

Each tip also has a stiff, but flexible bar extending from the shank portion with the cleaning element attached to this bar. In a first tip, the bar is rectangular in cross section and has a constant thickness along its length from the shank to the distal end. This first tip is provided with a multiplicity of bristles which extend from the periphery of the rectangular bar substantially along its entire length. The length of the bristles decreases in a direction toward the distal end to provide a tapered cleaning surface. The tapered cleaning surface permits the use of this tool to clean openings of various sizes.

A second cleaning tip also has a bar which extends from its shank portion; however the thickness of the bar decreases in a direction toward its distal end. The outer periphery of the rectangular bar is covered with a woven cloth material, which may be cotton, such that the exterior surface of the cloth is in a rectangular configuration and wherein the height of the rectangle decreases in a direction toward the distal end of the bar. The woven cotton cloth material is durable enough to withstand adequate cleaning action, yet also has the ability to absorb cleaning solvent applied by the first tip. The second tip removes any foreign particles that are loosened and suspended by the use of the bristle tip and cleaning solvent. Alternatively, the bar can be made of uniform thickness throughout its length and the thickness of the woven cotton cloth reduced in a direction toward the distal end of the bar. This will present a cleaning surface which tapers in thickness from the shank portion to the distal end.

A third cleaning tip is also provided which has a bar extending from its shank portion, this bar also having a rectangular cross section. As with the second tip, the thickness of this bar decreases in a direction toward its distal end. A multiplicity of soft cotton fibers are attached to the outer surface of the third bar and extend substantially along its entire length. The free ends of the cotton fibers on the top and bottom of the bar define planes which converge in the direction toward the distal end of the bar. Again, this is to enable the use of the tool with various sized rectangular openings. The soft cotton fibers of the third tip may be used to apply oil to the area that has previously been cleaned by the use of the first and second tips.

The third tip may also be formed of a bar having uniform thickness along its length and the length of the cotton fibers reduced in a direction toward the distal end of the bar so as to present a tapered cleaning surface.

In an alternative embodiment, a handle may be integrally formed on the shank portion of each tip. This would reduce manufacturing costs by eliminating the spring clip latch mechanism. Such integral handle/tip cleaning tools could be discarded after using with a minimum of expense to the user.

BRIEF DESCRIPTION OF DRAWINGS

FIG. 1 is a top view of the gun cleaning tool according to the invention with the bristle tip inserted into the handle.

FIG. 2 is a cross-sectional view of the bristle tip taken along lines A—A in FIG. 1.

FIG. 3 is a side view, partially in secton, of the handle and tip shown in FIG. 1.

FIG. 4 is a top view of a second tip covered with woven cloth.

FIG. 5 is a cross-sectional view of the tip of FIG. 4, taken along lines B—B.

FIG. 6 is a side view of the tip shown in FIG. 4.

FIG. 7 is a side view of a third tip showing the cotton fibers attached to the bar.

FIG. 8 is a cross-sectional view of the tip shown in FIG. 7, taken along lines C—C.

FIG. 9 is a perspective view showing the tool according to the invention cleaning the ventilating rib of the gun barrel.

DETAILED DESCRIPTION OF PREFERRED EMBODIMENT

Figure 10:
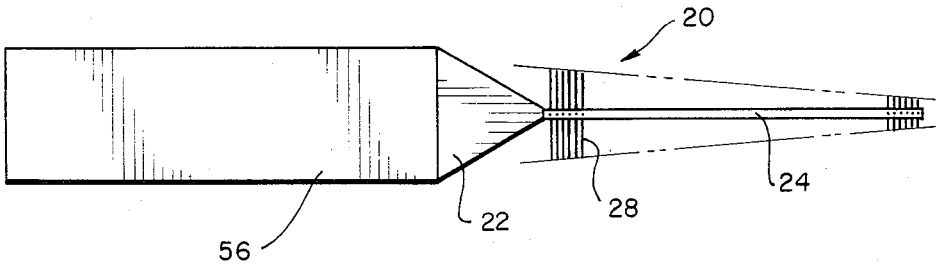
FIG. 10 is a side view of an alternative embodiment of the instant invention showing an integral handle and tip.

The gun cleaning tool according to the instant invention, and as best seen in FIGS. 1 and 3, has a handle 10 which defines a bore 12 extending from one end of handle 10 partially along its length. Bore 12 may have any cross section, but it is preferred that the cross section be polygonal rather than circular in order to enable the application of torque from handle 10 to one of the tips, which will be described hereinafter. Handle 10 has spring clip 14 mounted in cavity 16. End 14*a* is rigidly attached to handle 10, while opposite end 14*b* is free to move within cavity 16 in a direction generally perpendicular to a longitudinal axis of handle 10. Raised portion 14*c* is disposed between ends 14*a* and 14*b*, for a purpose which will be hereinafter described. Push button 18 is slidably retained in cavity 20 defined by handle 10. Push button 18 bears against end 14*b* of spring clip 14 such that, as push button 18 is depressed, it imparts similar movement to end 14*b*. This movement also moves raised portion 14*c* downwardly into cavity 16, such that a tip retained within handle 10 by raised portion 14*c* may be readily removed therefrom.

In order to adequately clean any part of a gun, solvent must be applied with a scrubbing action; a second operation must dislodge the loosened particles and absorb the cleaning solvent; and a third operation applies oil to the cleaned area in order to prevent rust or corrosion. In order to carry out these operations, applicants' invention provides three different tips which may be utilized with the handle described above. A first tip, indicated generally at 20, comprises a shank portion 22 having a bar 24 extending therefrom. Shank 22 is of a generally polygonal cross section corresponding to bore 12 such that the shank may be readily inserted into bore 12. Shank 22 also defines notch 26 which extends laterally across the width of shank 22. As best seen in FIG. 3, notch 26 engages raised portion 14*c* of spring clip 14 when the shank 22 is inserted into handle 10 so as to retain them in an assembled relationship.

Bar 24 which extends from shank 22 is generally rectangular in cross section, as shown in FIG. 2. Bar 24 also has a constant thickness and width along its length. A multiplicity of bristles 28 are attached to the outer surface of bar 24 and extend substantially along the entire length thereof. As seen in FIG. 3, the lengths of the bristles adjacent the shank portion 22 are greater than the lengths of the bristles adjacent the distal end of bar 24. The thickness $t_1$ measured between the ends of the bristles 28 adjacent shank portion 22 is greater than the thickness $t_2$ measured between the ends of bristles 28 located at the distal end of bar 24. The lengths of bristles 28 are graduated such that their ends present a tapered cleaning surface having its smaller end adjacent the distal end of bar 24.

Since the bristles 28 adjacent shank 22 are of greater lengths than those adjacent the distal end of bar 24, the width $w_1$ is greater than the width $w_2$ near the distal end, as shown in FIG. 1. This also presents tapered cleaning surfaces. The bristles on the first tip allow the user to apply solvent to the area to be cleaned and to exert a scrubbing action thereon.

The second cleaning tip 30, as shown in FIGS. 4–6, enables the user to remove the foreign particles and to absorb the cleaning solvent. This second tip also comprises a shank portion 32 having a bar 34 extending therefrom. Shank 32 also defines a notch 36 extending across its width in order to engage raised portion 14*c* of spring clip 14, as previously described. Bar 34 is covered with a woven cotton cloth material 38 in order to absorb the cleaning solvent and to provide a durable cleaning surface.

Bar 34, unlike previously described bar 24, has a thickness that decreases toward the distal end thereof. Thus, the thickness of bar 34 adjacent shank 32, designated by $t_3$, is greater than the thickness $t_4$ at the distal end. Bar 34 tapers uniformly in a direction from the shank toward its distal end. Cloth covering 38 is affixed to bar 34 such that its outer surface defines a rectangle of decreasing thickness in a direction toward the distal end of bar 34.

In order to enable the user to apply oil to the area between the ventilated rib and the gun barrel, the instant invention provides a third tip, identified as element 40 in FIG. 7. Tip 40 is generally similar in configuration to previously described tip 30, and has shank portion 42 with tapering bar 44 extending therefrom. As in tip 30, bar 44 has a greater thickness adjacent shank 42 than at its distal end so as to provide a tapered cleaning surface. Shank 42 also defines notch 46 which extends across its width and serves to engage raised portion 14*c* of spring clip 14 when this tip is inserted into the handle. Bar 44 has a multiplicity of soft cotton fibers 48 permanently affixed to its outer periphery and extending substantially along its entire length. The free ends of the cotton fibers 48 on the top and bottom surface of bar 44 define planes which converge in a direction toward the distal end of bar 44 to, once again, provide a tapered cleaning surface and enable the use of this tool with various sized openings. The cotton fibers also extend from the sides of bar 44, but these need not necessarily provide a tapered cleaning surface.

The method of using applicants' invention is shown in FIG. 9 wherein handle 10 is shown with tip 30 attached thereto and inserted in a space defined by the upper surface of gun barrel 50, ventilated rib 52, and supports 54. The tapered cleaning and oiling surfaces provided by the tips according to applicants' invention enable the operator to quickly and efficiently clean any sized openings between the ventilated rib and gun barrel. It is envisioned that the handle and tips may be fabricated from a nylon plastic material, although, quite obviously, other materials may be utilized without exceeding the scope of this invention. The bristles of tip 20 may also be of a nylon material. Regardless of the material from which tips 20, 30 and 40 are fabricated, the bar of each of these, elements 24, 34 and 44, respectively, should be somewhat resilient, while at the same time being sufficiently stiff, to enable the user to apply sufficient scrubbing force to remove the dirt and foreign particles. The three separate tips may be included into a kit including the handle and sold as a unit to gun owners. Quite obviously, the elements according to aplicants' invention may also be marketed separately or in any combination.

An alternative embodiment of the instant invention is shown in FIG. 10. In this embodiment, tip 20 is formed with integral handle 56. Integral handle 56 may be formed from plastic, such as nylon, and may be covered on its outer surface with a material to facilitate gripping by the user. Although integral handle 56 is shown associated with tip 20, it is to be understood that similar handles may also be formed on tips 30 and 40. The integral handle and tip cleaning tools eliminate the need for a separate latching mechanism and may be discarded by the user when their utility has been exhausted.

Figure 11:
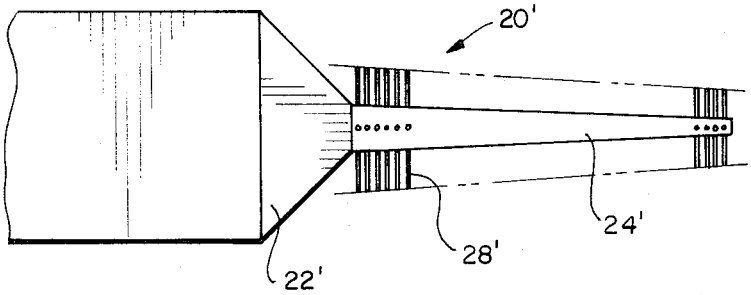
FIG. 11 is a partial side view of an alternative embodiment of the bristle tip according to the invention.
Figure 12:
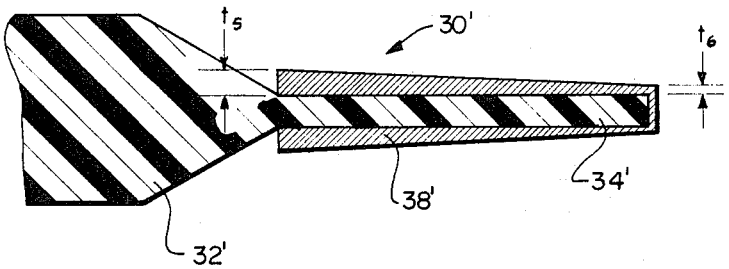
FIG. 12 is a partial side-sectional view of an alternative embodiment of the cloth covered tip according to the invention.
Figure 13:
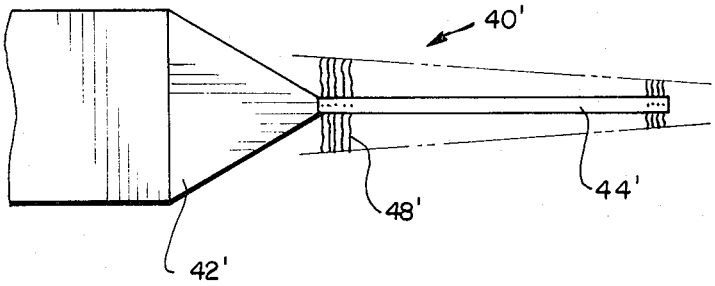
FIG. 13 is a partial side view of an alternative embodiment of the cotton fiber covered tip according to the invention.

Alternative embodiments of tips 20, 30 and 40 are shown in FIGS. 11–13. Tip 20', shown in FIG. 11, differs from tip 20 insofar as bar 24' has a generally rectangular cross section that diminishes in height in a direction toward the distal end of bar 24'. Thus, bristles 28' may be of equal length and still present a cleaning surface that tapers in a direction toward the distal end of bar 24'.

FIG. 12 shows an alternative embodiment of tip 30 wherein bar 34' is formed with a generally rectangular cross section of uniform height throughout its length. Woven cotton cloth material 38' is attached to bar 34' as previously described, but cloth 38' has a thickness which decreases in a direction toward the distal end of bar 34'. Thus, in FIG. 12, the thickness $t_5$ is greater than thickness $t_6$ such that a tapered cleaning surface is presented by the outer surface of woven cotton cloth 38'.

Similarly, the bar 44 of tip 40 may be formed of constant cross section as indicated at 44' in FIG. 13. In this instance, cotton fibers 48' have a diminishing length in the direction of the distal end of bar 44' such that their free ends define planes which converge in a direction toward the distal end of bar 44'.

It is to be understood that the alternative tips 20', 30' and 40' may be formed with a shank as previously described to be removably attachable to a separate handle, or they may be formed with an integral handle as illustrated in FIG. 10.

The foregoing description of the preferred embodiment is provided for illustrative purposes only and should not be construed as in any way limiting the scope of this invention, which is defined solely by the appended claims.

We claim:

1. A gun cleaning tool comprising:

(a) a handle to facilitate manual manipulation by the user;

(b) a tip extending from the handle, the tip having: (i) a shank portion which extends from the handle; (ii) a stiffly resilient bar having a generally rectangular cross section defining top, bottom, and side surfaces extending from the shank portion, the resilient bar having a distal end; and (iii) cleaning means attached to at least the top and bottom surfaces and extending along the length of the bar, the distance between the exterior surfaces of the cleaning means on the top and bottom surfaces defining a thickness which decreases toward the distal end of the bar; and, (c) latching means to removably attach the tip to the handle.

2. The gun cleaning tool of claim 1 wherein the handle defines a bore extending into the handle from one end thereof at least partially along the length of the handle, and wherein the latching means are disposed within the handle.

3. The cleaning tool of claim 2 wherein the cleaning means comprises a multiplicity of bristles extending from the periphery of the rectangular bar along its length, the length of the bristles decreasing in a direction toward the distal end of the bar.

4. The cleaning tool of claim 3 wherein the shank portion of the tip defines a notch in one side, and wherein the latch means comprises:

(a) a spring clip having one end attached to the handle, a free end capable of movement in a direction generally perpendicular to the longitudinal axis of the handle, and a raised portion between the ends, the raised portion engaging the notch in the shank portion to retain the tip within the handle; and (b) push button means slidably disposed in the handle and contacting the free end of the spring clip such that, when the push button is moved toward the spring clip, it displaces the free end of the clip along its path of movement to disengage the raised portion from the notch in the shank portion and allowing the tip to be removed from the handle.

5. The cleaning tool of claim 3 wherein the shank, bar and bristles are formed of a plastic material.

6. The cleaning tool of claim 5 wherein the plastic material is nylon.

7. The cleaning tool of claim 2 wherein the rectangular bar defines a thickness which decreases in a direction toward its distal end and the cleaning means comprises a woven cotton cloth attached to the rectangular bar such that an exterior surface of the cloth is in a rectangular configuration wherein the height of the rectangle decreases in a direction toward the distal end of the bar.

8. The cleaning tool of claim 7 wherein the shank portion of the tip defines a notch in one side, and wherein the latch comprises:

(a) a spring clip having one end attached to the handle, a free end capable of movement in a direction generally perpendicular to the longitudinal axis of the handle, and a raised portion between the ends, the raised portion engaging the notch in the shank portion to retain the tip within the handle; and (b) push button means slidably disposed in the handle and contacting the free end of the spring clip such that, when the push button is moved toward the spring clip, it displaces the free end of the clip along its path of movement to disengage the raised portion from the notch in the shank portion and allowing the tip to be removed from the handle.

9. The cleaning tool of claim 7 wherein the shank and bar are formed of a plastic material.

10. The cleaning tool of claim 9 wherein the plastic material is nylon.

11. The cleaning tool of claim 2 wherein the rectangular bar defines a thickness which decreases in a direction toward its distal end and the cleaning means comprises a multiplicity of soft cotton fibers attached to the rectangular bar each having a free end, the free ends of the cotton fibers on the top and bottom surfaces of the bar defining planes which converge in a direction toward the distal end of the bar.

12. The cleaning tool of claim 11 wherein the shank portion of the tip defines a notch in one side, and wherein the latch means comprises:

(a) a spring clip having one end attached to the handle, a free end capable of movement in a direction generally perpendicular to the longitudinal axis of the handle, and a raised portion between the ends, the raised portion engaging the notch in the shank portion to retain the tip within the handle; and (b) push button means slidably disposed in the handle and contacting the free end of the spring clip such that, when the push button is moved toward the spring clip, it displaces the free end of the clip along its path of movement to disengage the raised portion from the notch in the shank portion and allowing the tip to be removed from the handle.

13. The cleaning tool of claim 11 wherein the shank and bar are formed of a plastic material.

14. The cleaning tool of claim 13 wherein the plastic material is nylon.

15. The cleaning tool of claim 2 wherein the shank portion of the tip defines a notch in one side, and wherein the latch means comprises:

(a) a spring clip having one end attached to the handle, a free end capable of movement in a direction generally perpendicular to the longitudinal axis of the handle, and a raised portion between the ends, the raised portion engaging the notch in the shank portion to retain the tip within the handle; and (b) push button means slidably disposed in the handle and contacting the free end of the spring clip such that, when the push button is moved toward the spring clip, it displaces the free end of the clip along its path of movement to disengage the raised portion from the notch in the shank portion and allowing the tip to be removed from the handle.

16. A kit for cleaning the ventilated rib of a gun barrel or the like, wherein the kit comprises:

(a) a handle having a bore extending into the handle from one end thereof at least partially along its length, the handle having a manually actuable latching mechanism therein;

(b) a first tip removably attachable to to the handle, the first tip having:

(i) a first shank portion insertable into the bore of the handle, the first shank portion defining a notch to engage the latching mechanism;

(ii) a stiffly resilient first bar defining a rectangular cross section and extending from the first shank portion and having a distal end; and (iii) a multiplicity of bristles extending from the periphery of the first bar along its length, the length of the bristles decreasing in a direction toward the distal end of the bar;

(c) a second tip removably attachable to the handle, the second tip having:

(i) a second shank portion insertable into the bore of the handle, the second shank portion defining a notch to engage the latching mechanism of the handle;

(ii) a stiffly resilient second bar defining a rectangular cross section and extending from the second shank portion, the second bar having a thickness which decreases in a direction toward a distal end thereof; and (iii) a woven cotton cloth attached to the second rectangular bar such that the exterior surface of the cloth is in a rectangular configuration wherein the height of the rectangle decreases in a direction toward the distal end of the second bar; and (d) a third tip removably attachable to the handle, the third tip having:

(i) a third shank portion insertable into the bore of the handle, the third shank portion defining a notch to engage the latching mechanism of the handle;

(ii) a stiffly resilient third bar having a rectangular cross section defining top, bottom and side surfaces extending from the third shank portion, the third bar defining a thickness which decreases in a direction toward a distal end thereof; and (iii) a multiplicity of soft cotton fibers each having a free end attached to at least the top and bottom surfaces of the rectangular bar such that the free ends of the cotton fibers on the top and bottom surfaces of the third bar define planes which converge in a direction toward the distal end of the third bar.

* * * * *